US010947771B2

(12) United States Patent
Hsieh

(10) Patent No.: US 10,947,771 B2
(45) Date of Patent: Mar. 16, 2021

(54) CONTROL SYSTEM FOR FIRE DOOR AND A DOOR OPERATOR HAVING THE SAME

(71) Applicant: Chung Hsien Hsieh, New Taipei (TW)

(72) Inventor: Chung Hsien Hsieh, New Taipei (TW)

( * ) Notice: Subject to any disclaimer, the term of this patent is extended or adjusted under 35 U.S.C. 154(b) by 214 days.

(21) Appl. No.: 16/296,340

(22) Filed: Mar. 8, 2019

(65) Prior Publication Data

US 2020/0080360 A1 Mar. 12, 2020

(30) Foreign Application Priority Data

Sep. 11, 2018 (TW) ..... 107131897

(51) Int. Cl.
*E05F 15/20* (2006.01)
*E05F 15/72* (2015.01)
*E05F 15/603* (2015.01)

(52) U.S. Cl.
CPC ..... *E05F 15/72* (2015.01); *E05F 15/603* (2015.01); *E05Y 2900/134* (2013.01)

(58) Field of Classification Search
CPC .. E05F 15/72; E05F 15/603; E05Y 2900/134; E05Y 2800/246; E05Y 2400/40
See application file for complete search history.

(56) References Cited

U.S. PATENT DOCUMENTS 5,642,767 A 7/1997 Nair
6,014,307 A * 1/2000 Crimmins ..... E06B 9/68 361/170
6,484,784 B1 * 11/2002 Weik, III ..... E05F 1/006 160/7
7,737,860 B2 * 6/2010 Banta ..... E06B 9/68 340/691.6
8,567,573 B2 10/2013 Hsieh
8,671,622 B2 * 3/2014 Thomas ..... E06B 9/04 49/360

(Continued)

FOREIGN PATENT DOCUMENTS

CN 105320086 A 2/2016
CN 105952305 A 9/2016

(Continued)

OTHER PUBLICATIONS

Search Report dated Feb. 20, 2020 in Singapore Patent Application No. 10201903406T.

(Continued)

*Primary Examiner* — Jerry E Redman
(74) *Attorney, Agent, or Firm* — McClure, Qualey & Rodack, LLP

(57) ABSTRACT

A control system for a fire door and a door operator having the same are disclosed. The control system includes a fire door actuating module, a first control module and a second control module. The fire door actuating module is used to actuate a fire door. The first control module is electrically connected with the fire door actuating module to control the operation of the fire door actuating module. The second control module is electrically connected to the first control module and the fire door actuating module. The second control module monitors the operation of the first control module. When the operation of the first control module is abnormal, the second control module controls the operation of the fire door actuating module.

7 Claims, 5 Drawing Sheets

(56) References Cited

U.S. PATENT DOCUMENTS

| | | | | |
|---|---|---|---|---|
| 10,202,803 | B2 | 2/2019 | Hsieh | |
| 10,760,321 | B2 * | 9/2020 | Evans | E05F 15/72 |
| 2006/0101721 | A1 * | 5/2006 | Weik, III | A62C 2/24 52/1 |

FOREIGN PATENT DOCUMENTS

| | | | | |
|---|---|---|---|---|
| DE | 4342117 | A1 * | 6/1994 | E05F 15/56 |
| EP | 3267450 | A1 | 1/2018 | |
| JP | 5920944 | B2 | 5/2016 | |
| TW | 201305426 | A1 | 2/2013 | |
| TW | 201712212 | A | 4/2017 | |
| WO | 2014128480 | A2 | 8/2014 | |

OTHER PUBLICATIONS

Written Opinion dated Feb. 20, 2020 in Singapore Patent Application No. 10201903406T.
TIPO Office Action dated May 14, 2019 in Taiwan application (No. 107131897).
Search Report issued in TIPO Office Action dated May 14, 2019 in Taiwan application (No. 107131897).

* cited by examiner

CONTROL SYSTEM FOR FIRE DOOR AND A DOOR OPERATOR HAVING THE SAME

BACKGROUND OF THE INVENTION

1. Field of the Invention

The present invention relates to a control system for fire door and a door operator having the same, in particular to a fire door control system capable of monitoring the door operator and interrupting the power, and a door operator having the control system.

2. Description of the Related Art

At present, in most frequent control systems for fire doors, the closing, activation and operation of the fire doors are processed only by microprocessor chips (MCU). By such control systems, in the event of a fire, the smoke and flame can be isolated within a period of escape time, so that people fleeing from the fire may be protected.

However, the internal circuitry of the microprocessor chips may have flaws, or the microprocessor chips may be affected by environmental factors, such as temperature, humidity, or voltage noise/interference, which will result in damage of the internal circuitry. As such, the microprocessor chip can be greatly affected in its efficiency to control, and may fail to timely and effectively activate the closing of the fire door. Therefore, in case the processor chips malfunction in the event of a fire accident, and fail to perform the required functions of the fire door, catastrophes might occur.

As such, there is an urgent need to provide a fire door control system having a power interruption monitoring mechanism or a door operator having said fire door control system, so that the operation of the microprocessor chips can be persistently monitored to ensure they operate normally, and in case they operate abnormally, the malfunctions can be eliminated. Consequently, effective closing of the fire door is ensured, and protection measures are reliably provided.

SUMMARY OF THE INVENTION

It is therefore an object of the present invention to provide a control system for a fire door that persistently monitors the operation of the primary control module of the door operator. Once it is detected that the control module operates abnormally, the control module is immediately reset and/or the subsidiary control module takes over the control of the opening or closing of the fire door to avoid the failure of the fire door in case of a fire accident or disaster.

In one aspect of the present invention, a control system for a fire door comprising: a fire door actuating module for actuating the fire door, a first control module electrically connected with the fire door actuating module for controlling the operation of the fire door actuating module; and a second control module electrically connected with the first control module and the fire door actuating module; wherein the second control module is configured to monitor the operation of the first control module and controls the operation of the fire door actuating module when the operation of the first control module is abnormal.

The first control module of the present invention is the primary control module, and the second control module is a subsidiary control module. The second control module serves to monitor the first control module. When the first control module malfunctions, and cannot be reset or resetting does not take effect, the second control module will immediately take over to control the operation of the fire door actuating module.

In a further aspect of the present invention, a door operator having the fire door control system as stated above is provided. In the fire door control system of the door operator, the fire door actuating module comprises an electromagnetic module secured to a stationary frame, and a brake disk assembly coupled to the fire door. When the fire door is to be closed, either the first or second control module is controlled to cancel the magnetic attraction force of the electromagnetic module, thereby disengaging the brake disc assembly from the electromagnetic module to release the fire door, so that the fire door can be automatically closed.

BRIEF DESCRIPTION OF THE DRAWINGS

Various aspects and embodiments of the application will be described with reference to the following figures. It should be appreciated that the figures are not necessarily drawn to scale, all details are not necessarily be shown in the drawings, and the same or similar elements appearing in multiple figures are indicated by like reference numbers.

DETAILED DESCRIPTION OF PREFERRED EMBODIMENTS

Figure 1:
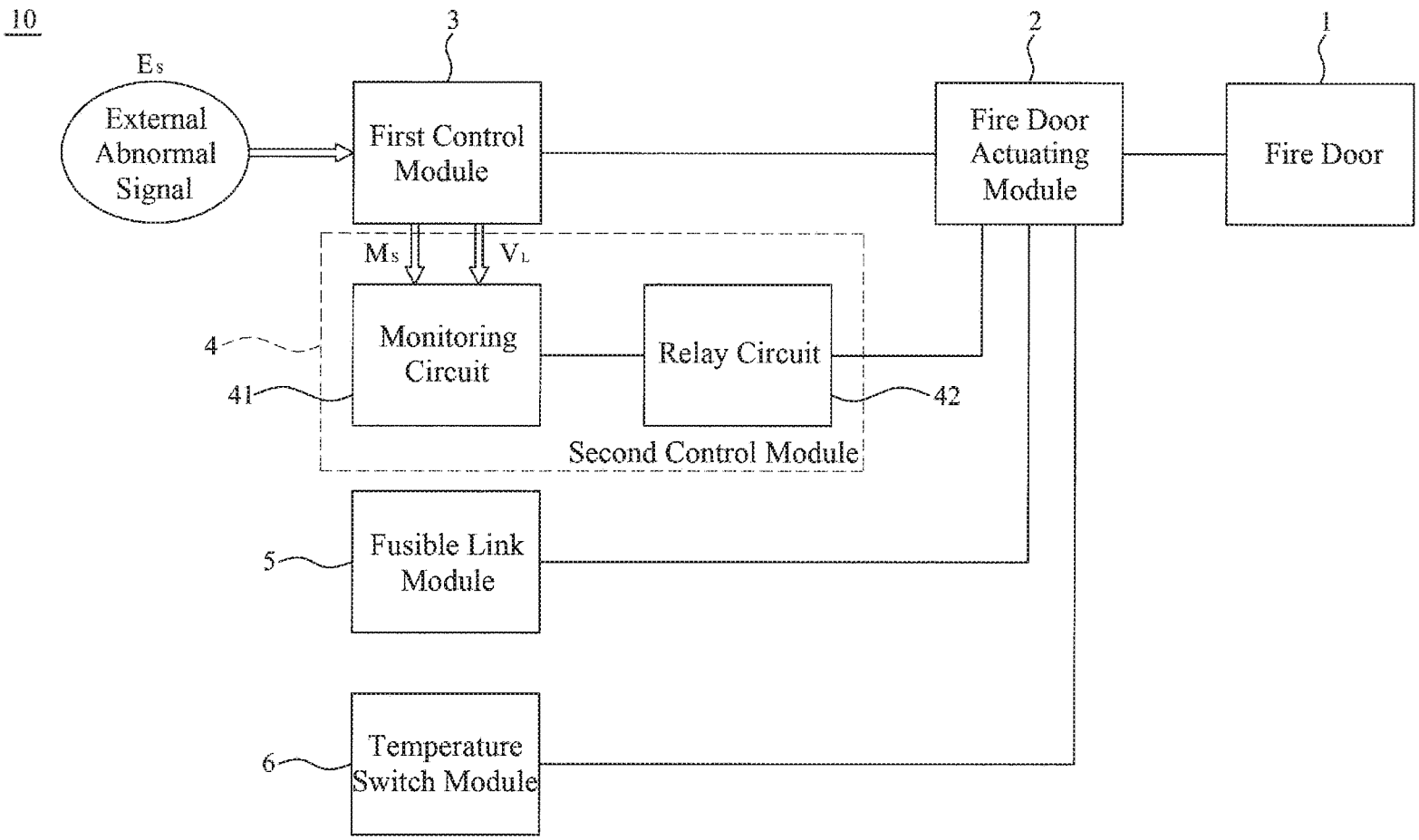
FIG. 1 shows a functional block diagram of a fire door control system according to a preferred embodiment of the present invention.

The present invention is related to a control system for fire door and a door operator having the same, in particular to a fire door control system capable of monitoring the door operator and interrupting the power, and a door operator having the control system. In the description, similar elements will be denoted by the same reference numerals. In addition, the drawings of the present invention are only intended to be illustrative, and are not necessarily drawn to scale, and all details are not necessarily be shown in the drawing.

Please refer to FIG. 1, which is a functional block diagram of a control system for a fire door in accordance with a preferred embodiment of the present invention. As shown, a control system 10 for a fire door primarily includes a fire door actuating module 2, a first control module 3, and a second control module 4. The fire door actuating module 2 serves to activate (in this embodiment, to release) a fire door 1. The first control module 3 is electrically connected to the fire door actuating module 2, and can be formed from a regular control module commonly used in existing door operators. The second control module 4 is electrically connected to the first control module 3 and the fire door actuating module 2.

In the normal operation state, the first control module 3 may control the closing operation of the fire door actuating module 2. On the other hand, the second control module 4 serves to monitor the first control module 3 to determine if the operation of the control module 3 is normal or not. In particular, when the second control module 4 detects that the first control module 3 is abnormal in operation and that restoring the same to normal is not possible, the second control module 4 can take over the control of the fire door actuating module 2, so as to maintain the normal operation.

Particularly, under any one of the two following situations, the second control module 4 will determine that the first control module 3 is abnormal in operation:

(1) the first control module 3 fails to control the fire door actuating module 2 to close the fire door when it receives an external abnormal signal $E_S$, for example a fire alarm signal, from the fire alarm receiver; or (2) as the result of a malfunction, the first control module 3 controls the fire door actuating module 2 to close the fire door 1 even though it does not receive an external abnormal signal $E_S$, for example a fire alarm signal.

When either one of the two situations as stated above happens, the second control module 4 will take over the control of the fire door actuating module 2, so that the fire door 1 may maintain its normal closing operation.

To achieve the above object, the second control module 4 includes a monitoring circuit 41 and a relay circuit 42. As shown in FIG. 1, the monitoring circuit 41 includes commonly known watchdog chips (WDTR IC). The monitoring circuit 41 is electrically connected to the first control module 3 and the relay circuit 42, and the relay circuit 42 is electrically connected to the fire door actuating module 2. When the monitoring circuit 41 detects an abnormal operation of the first control module 3, for example the first control module 3 fails to control the fire door actuating module 2 to close the fire door even when it receives an external abnormal signal $E_S$, the relay circuit 42 in the second control module 4 will immediately interrupt the power of the fire door actuating module 2 to forcibly release the fire door 1.

Further, in this embodiment, the second control module 4 may monitor the first control module 3 in real time by means of the monitoring signal Ms and the operating voltage (working voltage) $V_L$. During normal operation, the first control module 3 continuously transmits the monitoring signals Ms of 10~100 Hz to the monitoring circuit 41 of the second control module 4. When the monitoring circuit 41 fails to receive the monitoring signal Ms after a preset time period (for example, two seconds), the second control module 4 would determine that the first control module 3 is abnormal. In addition, the monitoring circuit 41 also continuously monitors the operating voltage $V_L$ of the first control module 3. When the operating voltage $V_L$ is higher and/or lower than a preset value, the second control module 4 would determine that the first control module 3 is abnormal.

When any one of the two situations stated above occurs, the possible causes are: crashes or frozen of the microprocessor in the first control module 3; breakdown of I/O; or malfunctions of other electronic components. At this instant, the second control module 4 will first try to reset the first control module 3 to resume its normal control mode. If it is not possible to reset the first control module 3, or the afore-mentioned situations are not improved after resetting, the relay circuit 42 of the second control module 4 will immediately interrupt the power of the fire door actuating module 2 to forcibly release the fire door 1 so that the fire door is shut automatically regardless of whether or not the external abnormal signal $E_S$ is received.

Consequently, under the circumstances that the fire door 1 is shut even in the absence of the external abnormal signal $E_S$, the operator will be able to determine that the first control module 3 is at fault. This situation can also be used as a notification of failure for the first control module 3. However, in some other embodiments of the present invention, the second control module 4 can also be configured to forcibly release the fire door 1 only when the first control module 3 and/or the second control module 4 receive the external abnormal signal $E_S$.

Referring again to FIG. 1, the fire door control system 10 further includes a fusible link module 5 and a temperature switch module 6. The fusible link module 5 is disposed outside the door operator. After the fusible link module 5 is melted down by the fire, the power of the fire door actuating module 2 is mechanically cut off, and the fire door 1 is released. On the other hand, the temperature switch module 6 is disposed inside the door operator for detecting the ambient temperature. When the temperature switch module 6 detects that the ambient temperature exceeds a predetermined high temperature value, it likewise interrupts the power of the fire door actuating module 2 to thereby automatically close the fire door 1. Accordingly, besides having the second control module 4 to monitor the first control module 3, this embodiment of the present invention provides further measures, for example the fusible link module 5 and the temperature switch module 6, to ensure that the fire door 1 operates normally in case of a fire accident.

Figure 2:
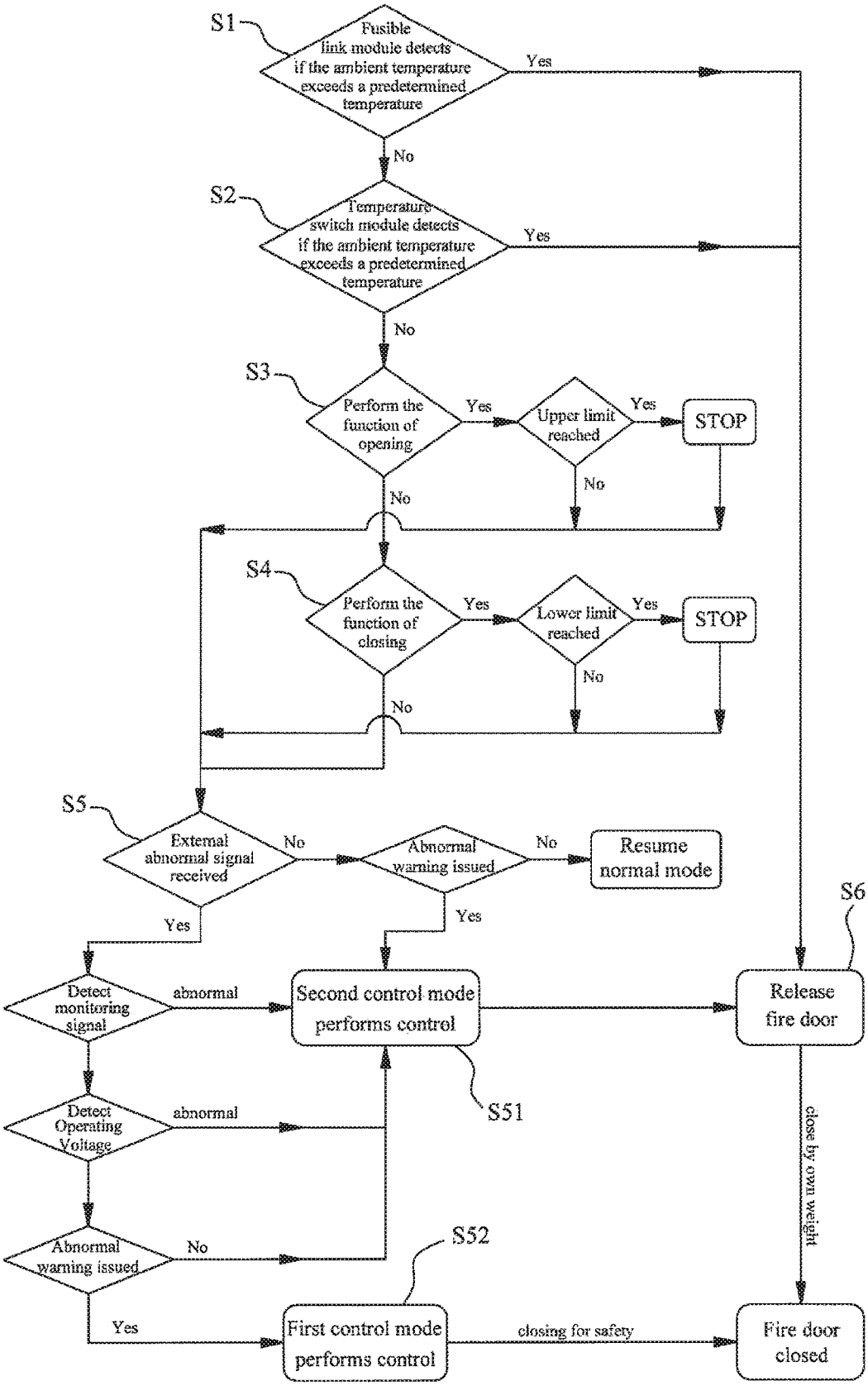
FIG. 2 is a flow chart showing the operation of the fire door control system according to a preferred embodiment of the present invention.

FIG. 2 shows a flow chart illustrating the operation of the fire door control system according to a preferred embodiment of the present invention. It should be noted that the fire door 1 mentioned in the following embodiments is a normal roll door under normal circumstances, and only serves as a fire door in case of fire. In steps S1 and S2, the two independent sensing modules, that are the fusible link module 5 and the temperature switch module 6, perform synchronous monitoring to determine if the external ambient temperature exceeds a predetermined temperature value. When the external ambient temperature is exceedingly high, step S6 is performed to forcibly release the fire door instantly.

Steps S3 and S4 are related to the fire door control system 10 under the normal operation mode, in which the first control module 3 is used to perform the function of opening or closing the fire door 1. In particular, when the function of opening or closing the fire door 1 is activated, the first control module 3 detects whether or not the ascending or descending of the fire door 1 reaches a preset threshold (for example, an upper or lower limit). When the fire door 1 reaches the preset threshold, the opening or closing operation of the fire door 1 is stopped immediately.

Subsequently, in step S5, in case the first control module 3 issues an abnormal warning signal even in the absence of an external abnormal signal $E_S$ being sent thereto, proceed to step S51. Step S6 is then performed, where the second control module 4 performs the control for releasing the fire door 1.

On the other hand, when an external abnormal signal $E_S$ is received, the second control module 4, besides monitoring whether or not the first control module 3 issues an abnormal warning signal, also monitors if the monitoring signal Ms of the first control module 3 is transmitted normally, and if the operating (working) voltage $V_L$ of the first control module 3 is normal.

When any one of the following situations occurs: (1) the first control module 3 fails to issue an abnormal warning signal; (2) the second control module 4 fails to receive the monitoring signal Ms; or (3) the operating voltage $V_L$ of the first control module 3 is abnormal; then proceed to step S51 where the second control module 4 performs the control.

On the contrary, if none of the above situations occurs, then proceed to step S52 where it is determined that the first control module 3 operates in a normal manner. Then the first control module 3 will be used to control the fire door actuating module 2 to close the fire door 1.

Figure 3:
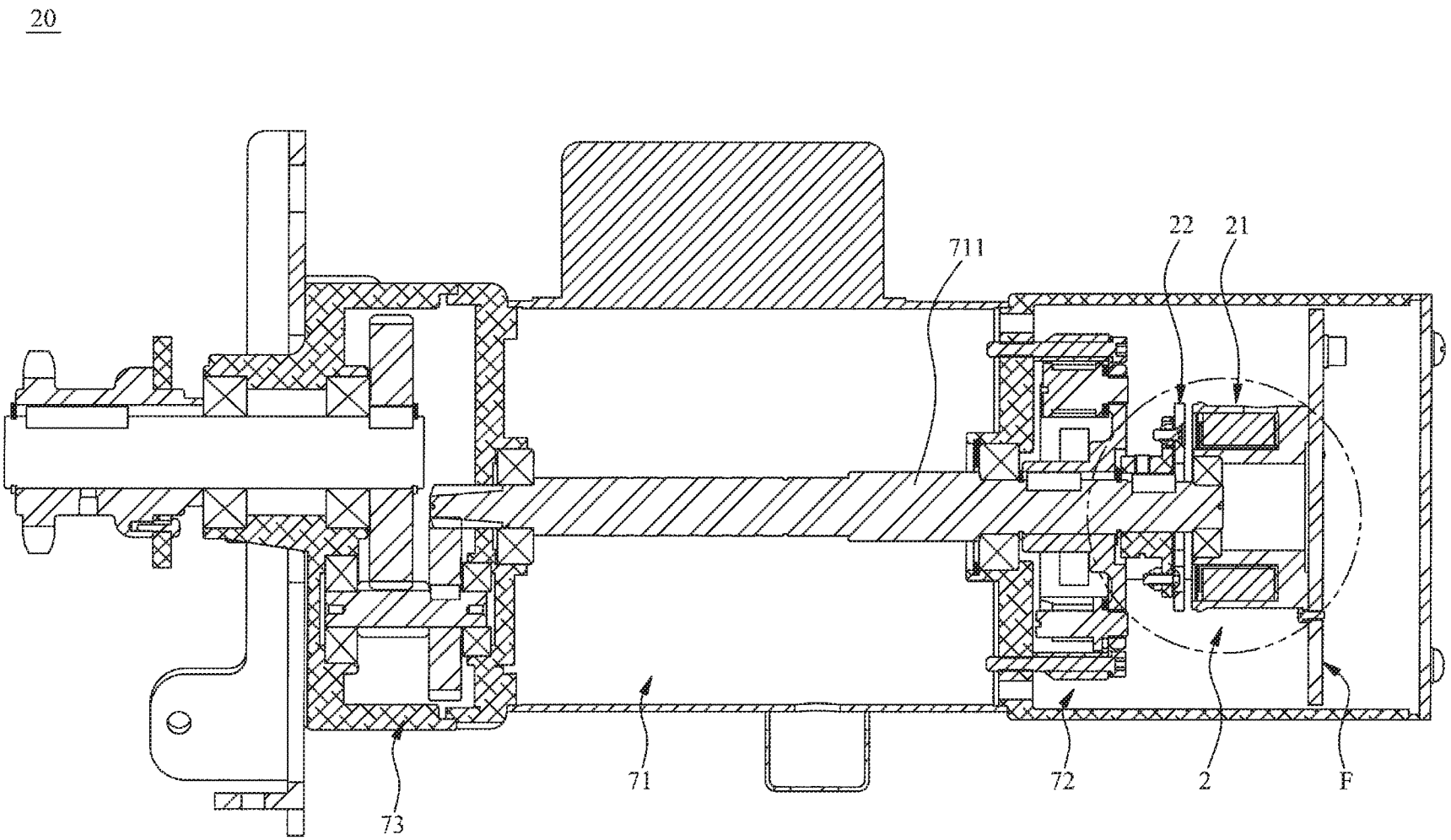
FIG. 3 is a cross-sectional view of a door operator according to a preferred embodiment of the present invention.
Figure 4:
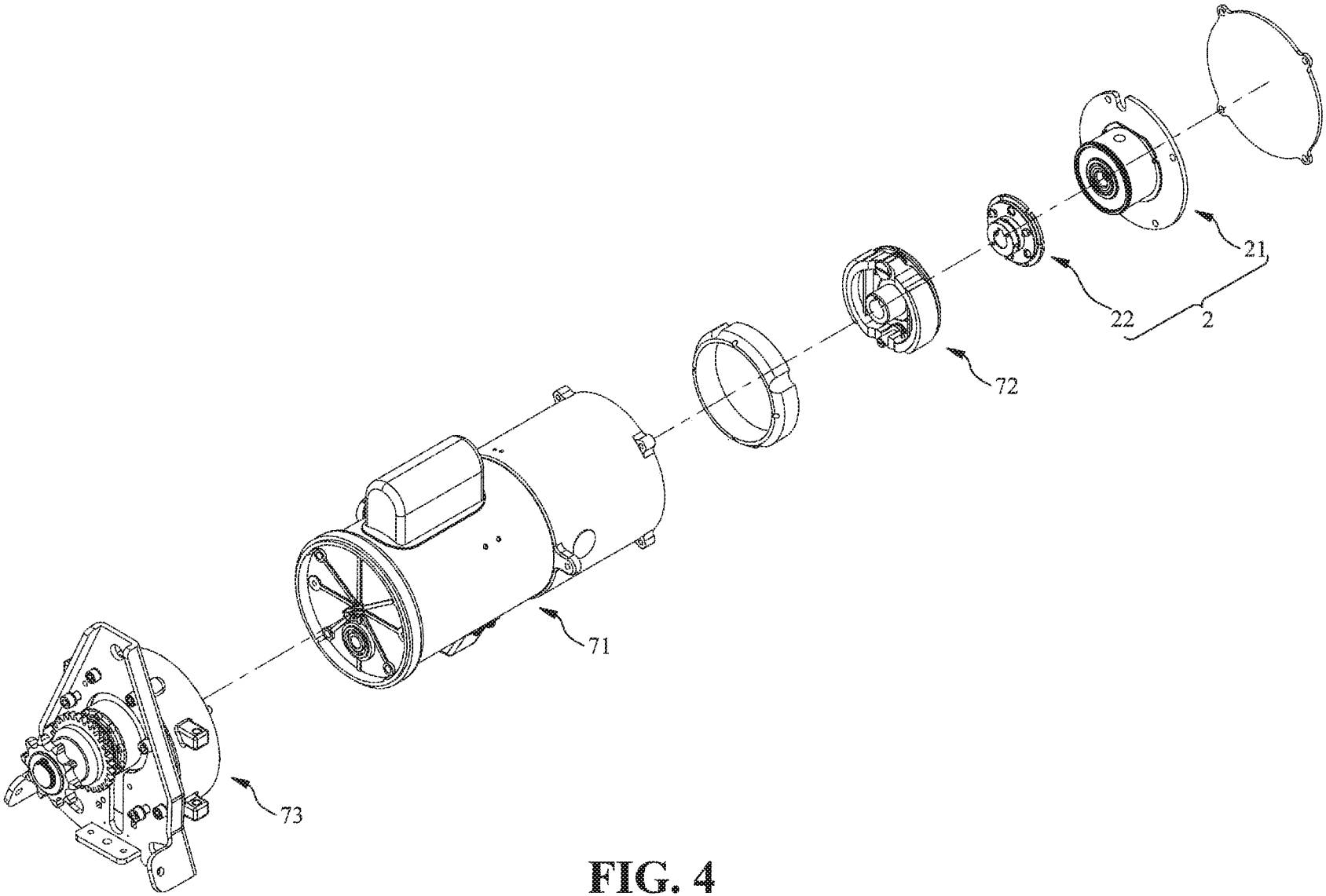
FIG. 4 is an exploded view of a door operator according to a preferred embodiment of the present invention.

Referring to FIGS. 3 and 4 which are a cross-sectional view and exploded view, respectively, of a door operator according to a preferred embodiment of the present invention. As shown, the door operator 20 primarily includes a motor 71 having a drive shaft 711, a centrifugal brake 72 disposed at one end of the drive shaft 711, and a speed reduction module 73. The centrifugal brake 72 serves primarily to convert the centrifugal force into a braking force to reduce the speed of the drive shaft 711 when the rotational speed of the drive shaft 711 is exceedingly fast. In addition, the speed reduction module 73 is disposed at the other end of the drive shaft 711, and primarily serves to reduce the rotational speed and increase the torque.

The door operator 20 besides having the components as found in the afore-mentioned embodiments, the fire door actuating module 2 further includes an electromagnetic module 21 fixed to a stationary frame F, and a brake disk assembly 22 coupled to the fire door 1. When the fire door 1 is to be closed, at least one of the first and second control module 3, 4 is controlled to cancel the magnetic attraction force of the electromagnetic module 21, so that the brake disc assembly may be disengaged from the electromagnetic module to release the fire door, thereby renders the fire door to close automatically.

Figure 5A:
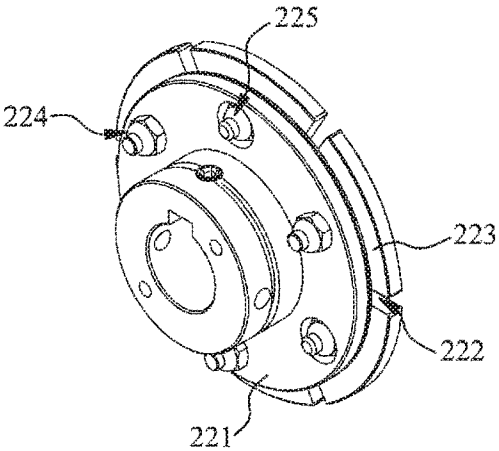
FIG. 5A is a perspective view of a brake disc assembly according to a preferred embodiment of the present invention.
Figure 5B:
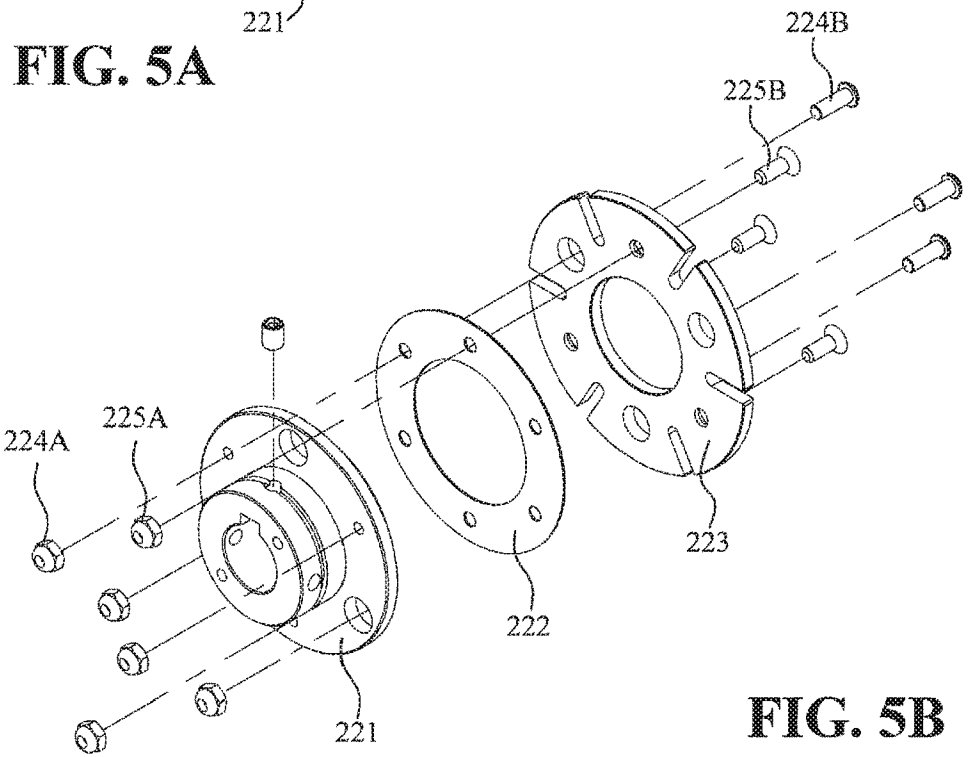
FIG. 5B is an exploded view of a brake disc assembly according to a preferred embodiment of the present invention.

Referring now to FIGS. 5A and 5B which show a perspective view and an exploded view, respectively, of a brake disc assembly according to a preferred embodiment of the present invention. As shown, the brake disc assembly 22 includes a coupling seat 221, a ring spring 222 and a brake disc 223. The coupling seat 221 is coupled to the fire door 1 through the drive shaft 711 and the speed reduction module 73, and the ring spring 222 is positioned between the coupling seat 221 and the brake disk 223. A portion of the annular spring plate 222 is coupled to the coupling seat 221 by means of a first locking member 224. The first locking member 224 includes three first nuts 224A and three corresponding first screws 224B to aid in fastening the annual spring 222 to the coupling seat 221. The other portion of the annular spring plate 222 is fastened to the brake disc 223 by means of a second locking member 225. The second locking member 225 includes three second nuts 225A and three corresponding second screws 225B to aid in fastening the annual spring 222 to the brake disc 223.

Figure 6A:
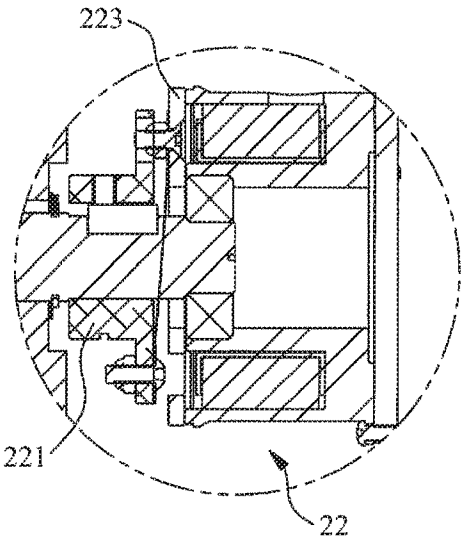
FIGS. 6A and 6B are schematic views showing the operation of a brake disc assembly according to a preferred embodiment of the present invention.
Figure 6B:
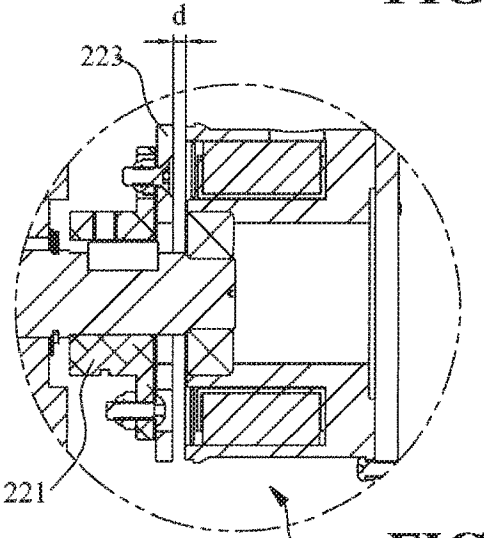

Referring to FIGS. 6A and 6B which schematically illustrate the operation of a brake disc assembly according to a preferred embodiment of the present invention. As shown in FIG. 6A, when the electromagnetic module 21 generates a magnetic attraction force, the brake disk 223 will be attracted to the surface of the electromagnetic module 21, and moved away from the coupling seat 221, thereby locking the fire door 1 to prevent it from closing. However, the annular spring plate 222 is subject to tensile deformation between the brake disc 223 and the coupling seat 221 by the magnetic attraction force. As shown in FIG. 6B, when either one of the first or second control module 3, 4 is controlled to cancel the magnetic attraction force generated by the electromagnetic module 21, the annular spring plate 222 will restore position by its elasticity. As such, the brake disc 223 moves away from the surface of the electromagnetic module 21 and attaches onto the surface of the coupling seat 221. In other words, a gap (d) will be formed between the brake disc 223 and the surface of the electromagnetic module 21, thus releasing the fire door and allow it to close automatically.

While this invention has been described with reference to specific and particularly preferred embodiments thereof, it is not limited thereto and the appended claims are intended to be construed to encompass not only the specific forms and variants of the invention shown but to such other forms and variants as may be devised by those skilled in the art without departing from the true scope of this invention.

What is claimed is:

1. A control system for a fire door, comprising:

a fire door actuating module for actuating the fire door; the fire door actuating module comprises an electromagnetic module secured to a stationary frame, and a brake disc assembly coupled to the fire door;

a first control module electrically connected with the fire door actuating module for controlling operation of the fire door actuating module; and a second control module electrically connected with the first control module and the fire door actuating module;

wherein the second control module is configured to monitor operation of the first control module and controls the operation of the fire door actuating module when the operation of the first control module is abnormal; wherein when the first control module receives an external abnormal signal and the first control module fails to control the fire door actuating module to close the fire door, or when the first control module does not receive the external abnormal signal and the first control module controls the fire door actuating module to close the fire door, the second control module determines that the operation of the first control module is abnormal;

wherein when the fire door is to be closed, at least one of the first and second control modules are controlled to cancel a magnetic attraction force of the electromagnetic module, thereby disengaging the brake disc assembly from the electromagnetic module to release the fire door, so that the fire door is automatically closed.

2. The control system of claim 1, wherein the second control module comprises a relay circuit electrically connected to the fire door actuating module; and a monitoring circuit electrically connected to the first control module and the relay circuit; wherein when the monitoring circuit detects an abnormal operation of the first control module, the relay circuit interrupts power of the fire door actuating module to release the fire door and thereby automatically close the fire door.

3. The control system of claim 2, wherein the first control module is configured to continuously transmit a monitoring signal to the monitoring circuit of the second control module, and the monitoring circuit is configured to continuously monitor an operating voltage of the first control module; the monitoring circuit resets the first control module when the monitoring circuit fails to receive the monitoring signal or the operating voltage of the first control module is lower than a default value.

4. The control system of claim 3, wherein when the monitoring circuit fails to reset the first control module, the relay circuit interrupts the power of the fire door actuating module to release the fire door to thereby automatically close the fire door.

5. The control system of claim 3, wherein when the monitoring circuit fails to reset the first control module, and the first control module receives the external abnormal signal, the relay circuit of the second control module interrupts the power of the fire door actuating module to release the fire door to thereby automatically close the fire door.

6. The control system of claim 1, further comprising a fusible link module and a temperature switch module connected to the fire door actuating module; and when at least one of the fusible link module and the temperature switch module detects a predetermined high temperature value, the first or second control module interrupts power of the fire door actuating module to thereby automatically close the fire door.

7. The control system of claim 1, wherein the brake disc assembly comprises a coupling seat coupled to the fire door, an annular spring plate and a brake disc, the annular spring plate is positioned between the coupling seat and the brake disc, the annular spring plate having a first portion coupled to the coupling seat, and a second portion coupled to the brake disc.

* * * * *